US011058262B2

(12) United States Patent
Hagleitner

(10) Patent No.: US 11,058,262 B2
(45) Date of Patent: Jul. 13, 2021

(54) DISPENSING SYSTEM FOR A FLOWABLE PRODUCT

(71) Applicant: Hans Georg Hagleitner, Zell am See (AT)

(72) Inventor: Hans Georg Hagleitner, Zell am See (AT)

( * ) Notice: Subject to any disclaimer, the term of this patent is extended or adjusted under 35 U.S.C. 154(b) by 0 days.

(21) Appl. No.: 16/677,766

(22) Filed: Nov. 8, 2019

(65) Prior Publication Data

US 2020/0069116 A1 Mar. 5, 2020

Related U.S. Application Data

(60) Division of application No. 15/187,143, filed on Jun. 20, 2016, now Pat. No. 10,531,769, which is a continuation of application No. PCT/AT2014/000222, filed on Dec. 15, 2014.

(30) Foreign Application Priority Data

Dec. 20, 2013 (AT) ..... A 975/2013

(51) Int. Cl.

| | |
|---|---|
| ***A47K 5/00*** | (2006.01) |
| ***A47K 5/13*** | (2006.01) |
| ***B65D 75/58*** | (2006.01) |
| ***B65D 41/02*** | (2006.01) |
| ***A47K 5/12*** | (2006.01) |
| ***B65D 43/12*** | (2006.01) |

(52) U.S. Cl.

CPC ..... *A47K 5/13* (2013.01); *A47K 5/12* (2013.01); *B65D 41/026* (2013.01); *B65D 43/12* (2013.01); *B65D 75/5877* (2013.01)

(58) Field of Classification Search

CPC ... A47K 5/00; A47K 5/10; A47K 5/12; A47K 5/13; B65D 43/12; B65D 43/14; B65D 43/20; B65D 41/02; B65D 41/026; B65D 41/16; G03G 15/0886; G03G 15/0855; G03G 15/0865

USPC ..... 222/173, 325, 559, 165

See application file for complete search history.

(56) References Cited

U.S. PATENT DOCUMENTS

| | | | |
|---|---|---|---|
| 1,897,890 A | 3/1931 | Cook | |
| 2,370,997 A | 5/1943 | Rudolph | |
| 2,436,297 A | 7/1944 | Guarnaschelli | |
| 4,570,827 A | 2/1986 | Roggenburg, Jr. et al. | |
| 4,942,432 A | 7/1990 | Mort | G03G 15/0881 141/319 |
| 5,040,024 A | 8/1991 | Fukuda | G03G 15/0882 222/DIG. 1 |

(Continued)

FOREIGN PATENT DOCUMENTS

| | | |
|---|---|---|
| CN | 1083011 A | 3/1994 |
| CN | 201971310 U | 9/2011 |

(Continued)

*Primary Examiner* — Charles P. Cheyney

(74) *Attorney, Agent, or Firm* — Laurence A. Greenberg; Werner H. Stemer; Ralph E. Locher

(57) ABSTRACT

A container has an opening lying in a plane, wherein the opening is provided on a connecting piece of the container. A closure of the container can be removed by displacement in the plane. At least one guide element is provided on the connecting piece, on or in which the closure can be displaced relative to the container. The closure has at least one recess on at least one of its outer surfaces.

11 Claims, 17 Drawing Sheets

(56) References Cited

U.S. PATENT DOCUMENTS

| | | | | |
|---|---|---|---|---|
| 5,089,854 | A | 2/1992 | Kaieda | G03G 15/0855 141/346 |
| 5,405,034 | A | 4/1995 | Mittel, Jr. | |
| 5,425,404 | A | 6/1995 | Dyer | B67D 3/0012 141/21 |
| 5,475,479 | A | 12/1995 | Hatakeyama | G03G 15/0865 399/119 |
| 5,593,068 | A | 1/1997 | Kitayama | G03G 15/0867 141/364 |
| 5,730,694 | A | 3/1998 | Hagleitner | |
| 5,737,675 | A * | 4/1998 | Okada | G03G 15/0865 399/258 |
| 6,210,638 | B1 | 4/2001 | Grieco et al. | |
| 6,212,721 | B1 | 4/2001 | Borodulin et al. | |
| 6,223,791 | B1 | 5/2001 | Arsenault | B67D 3/044 141/291 |
| 6,314,262 | B1 * | 11/2001 | Kunihiro | G03G 15/0867 222/DIG. 1 |
| 6,868,988 | B2 | 3/2005 | Ufheil | A47J 31/404 222/129.1 |
| 7,043,173 | B2 * | 5/2006 | Grune | G03G 15/0882 222/DIG. 1 |
| 7,832,595 | B2 | 11/2010 | Lickstein | |
| 8,261,945 | B2 | 9/2012 | Haworth | |
| 8,561,844 | B2 | 10/2013 | Hagleitner | |
| 2007/0108207 | A1 | 5/2007 | Malek | |
| 2009/0026225 | A1 | 1/2009 | Lickstein | |
| 2009/0272752 | A1 | 11/2009 | Hagleitner | B65D 75/5872 220/680 |
| 2011/0226772 | A1 | 9/2011 | Adler | |

FOREIGN PATENT DOCUMENTS

| | | | |
|---|---|---|---|
| CN | 202022412 | U | 11/2011 |
| DE | 29609142 | U1 | 8/1996 |
| DE | 102011120820 | A1 | 6/2013 |
| EP | 1719441 | A1 | 11/2006 |
| FR | 1107608 | A | 1/1956 |
| WO | 9509111 | A1 | 4/1995 |
| WO | 2008089500 | A2 | 7/2008 |
| WO | 2009013173 | A2 | 1/2009 |
| WO | 2013087189 | A2 | 6/2013 |

* cited by examiner

DISPENSING SYSTEM FOR A FLOWABLE PRODUCT

CROSS-REFERENCE TO RELATED APPLICATION

This application is a divisional of copending patent application Ser. No. 15/187,143, filed Jun. 20, 2016, which was a continuation, under 35 U.S.C. § 120, of copending international application No. PCT/AT2014/000222, filed Dec. 15, 2014, which designated the United States; this application also claims the priority, under 35 U.S.C. § 119, of Austrian patent application No. A 975/2013, filed Dec. 20, 2013; the prior applications are herewith incorporated by reference in their entirety.

BACKGROUND OF THE INVENTION

Field of the Invention

The invention concerns a container having an opening disposed in a plane and a closure removable by sliding in the plane, wherein the opening is provided on a connection of the container and wherein provided on the connection is at least one guide element at or in which the closure is slidable relative to the container.

The invention further also concerns a dispensing system for a flowable product containing at least one dispenser provided with a container mounting and at least one container containing the flowable product, which has a closure removable by displacement of the container and is held upside down in the container mounting after removal of the closure. Provided on the closure and on the container mounting are similar guide elements which supplement each other or prolong each other upon insertion of the closed container A container and a dispensing system of that kind are described for example in international patent disclosures WO 95/09111 (corresponding to U.S. Pat. No. 5,730,694) or WO 2008/089500 (corresponding to U.S. Pat. No. 8,561,844). The dispenser serves for dispensing liquid or creamy products, in particular in the sanitary and hygiene area like for example soaps, disinfectants, creams and so forth.

A container can be fitted into a dispenser if the region of the container, that surrounds the opening, is compatible with the container mounting of the dispenser. That is thus a prerequisite for being able to use the container at all, but it has the disadvantage that all containers of the same configuration or at least all containers with regions of the same configuration around the opening can be used without a container having the wrong contents being noticeable. That matching relationship is also referred to as coding, in which respect various degrees of coding can be established, which involve the number of the cooperating coding elements.

The container described in the state of the art has a container neck or connection, from which a respective limb of a sliding guide projects at both sides parallel to the end face, and on to which a clip-like C-shaped part which engages behind the limbs is pushed as the closure. Therefore the container mounting on the dispenser is of the same configuration as the closure, that is to say the limbs projecting from the connection have the container mounting engaging there behind. That makes changing the container easier as a new container can be fitted to and inserted into the container mounting without the closure having to be previously removed. That is advantageous in particular as the container is fitted upside down as the content cannot flow out of same or no additional measures are necessary to prevent that. As soon as the closure bears against the container mounting the container can be slid and the limbs of the connection slide in grooves of the container mounting, in which case finally the closure is released and lies loose in front of the container mounting.

SUMMARY OF THE INVENTION

As however it is desirable or also necessary to fill certain dispensers only with certain containers the object of the invention is to provide containers and a dispensing system which have a sliding closure and codings which extend beyond engagement of the sliding guide elements, to prevent the insertion of incorrect containers. According to the invention that is possible on the container in that the closure has at least one recess and/or projection at at least one of its outside surfaces. In matching relationship therewith provided in front of the container mounting is a deposit device for the closure, which retains the closure in a parking position during insertion of the container. Upon insertion of the closed container therefore recesses and/or projections of the closure and projections and/or recesses of the deposit device engage into each other. If there is no conformity here then the closure cannot be placed in the required position in front of the container mounting and insertion of the connection of the container into the container mounting fails. If nonetheless that is attempted, the end result of that is generally that a part of the container content pours out uncontrollably into the lower portion of the dispenser.

Preferably the closure is in the form of a body which is profiled approximately in a C-shape and which engages behind limbs projecting at both sides on the connection and which thus has outside surfaces parallel and perpendicular to the slide direction, which are perpendicular to the plane of the container opening, and an outside surface extending parallel to the plane. The latter bears externally against the central part of the body which is of a C-shaped profile and the inside surface of the central part seals off the container opening. The thickness of the central part is of a significance which is discussed hereinafter.

Recesses and/or projections can be provided at each of the above-listed outside surfaces, in which respect that also determines insertion and removal of the container.

In a preferred embodiment it is provided that a substantially L-shaped travel path is established for insertion of the closed container into the dispenser, the first travel path portion thereof extending into the deposit device perpendicularly to the slide direction of the container.

The closed container is therefore moved along the first path portion into the deposit device, from which, as the closure is put into intermediate storage there in the parking position, the container can only be further moved into the container mounting by way of the second path portion.

The container mounting preferably represents an upper cover of a collecting chamber for the product to be dispensed, for example an intermediate container, a pump inlet chamber or the like. Projections on the deposit device are therefore preferably of such a configuration that, by virtue of the removal thereof, for example to insert a non-correlating container, a hole is opened into the collecting chamber and the dispenser thereby losses it's sealing integrity.

In a further preferred embodiment it is provided that the deposit device for the closure is provided in a depression in the cover plate at the end of the first path portion.

In that case the depth of the depression corresponds to the above-mentioned thickness of the central part of the closure so that, upon conformity of the coding elements as between the closure and the deposit device, the inside surface of the central part of the closure aligns with the plane of the opening of the container mounting.

Other features which are considered as characteristic for the invention are set forth in the appended claims.

Although the invention is illustrated and described herein as embodied in a container and a dispensing system, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE SEVERAL VIEWS OF THE DRAWING

FIG. 14 is a sectional view taken along the line XIV-XIV shown in

FIG. 13;

FIG. 19 is a diagrammatic perspective view of a first embodiment of the dispenser for soap or the like;

FIG. 25 is a diagrammatic perspective view of a second embodiment of the dispenser for soap or the like;

DETAILED DESCRIPTION OF THE INVENTION

Figure 1:
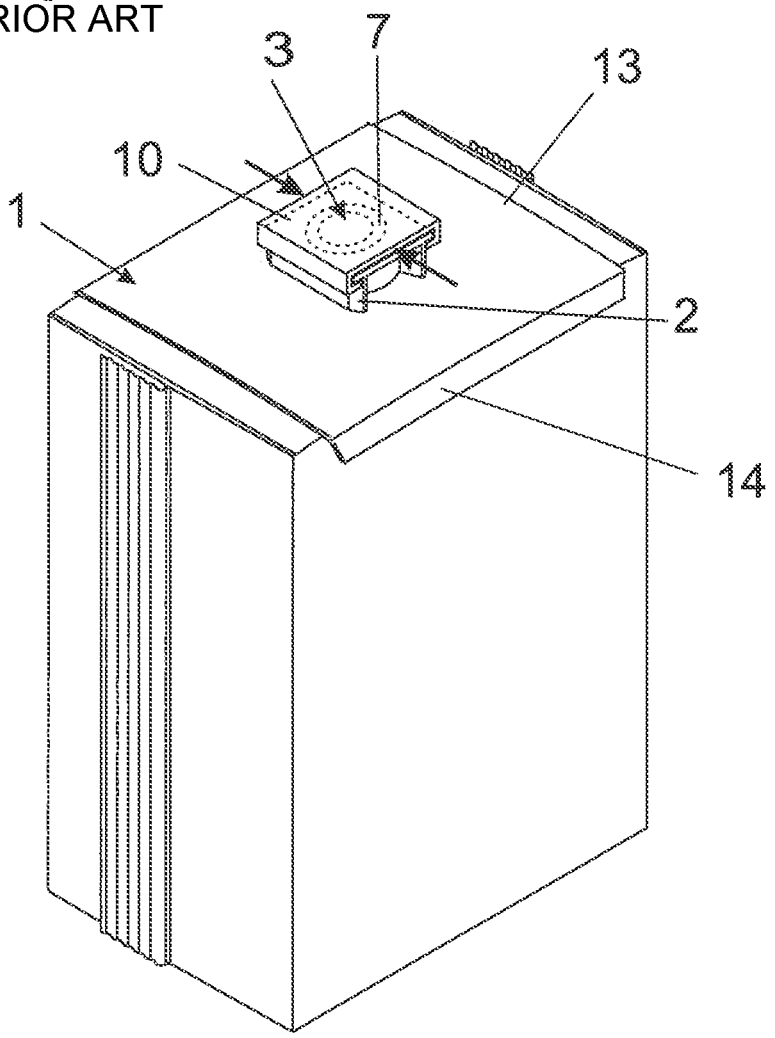
Fig. 1 PRIOR ART
FIG. 1 is a diagrammatic, perspective view of a closed container according to the prior art.

Referring now to the figures of the drawings in detail and first, particularly to FIG. 1 thereof, there is shown a container 1 formed from a soft flexible material, for example a thin plastic film, and is approximately cuboidal. A wall of the container is provided in particular with a reinforcing plate 13 has an opening 3 provided within a sealingly closable connection 2 or container neck. As FIG. 1 shows the reinforcing plate 13 extends over a large part of the area of the wall and with side limbs 14 embraces two oppositely disposed edges of the container 1. Details about such a container 1 and its manufacture are to be found in above-mentioned international patent disclosure WO 2008/089500.

Figure 19:
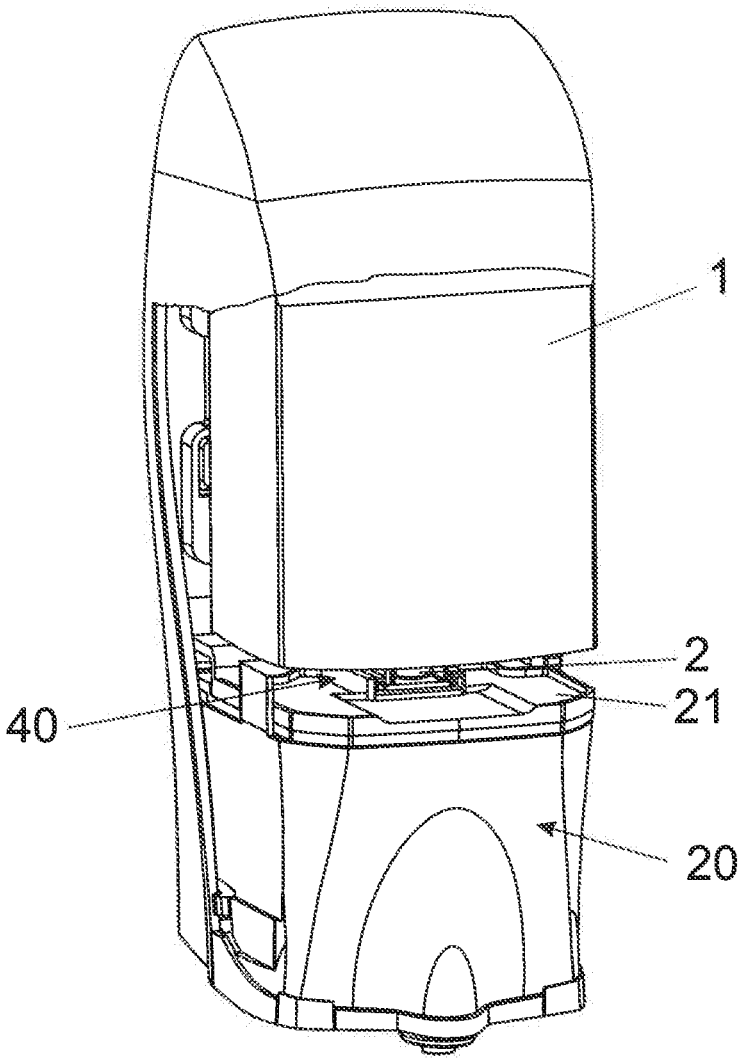
Figure 25:
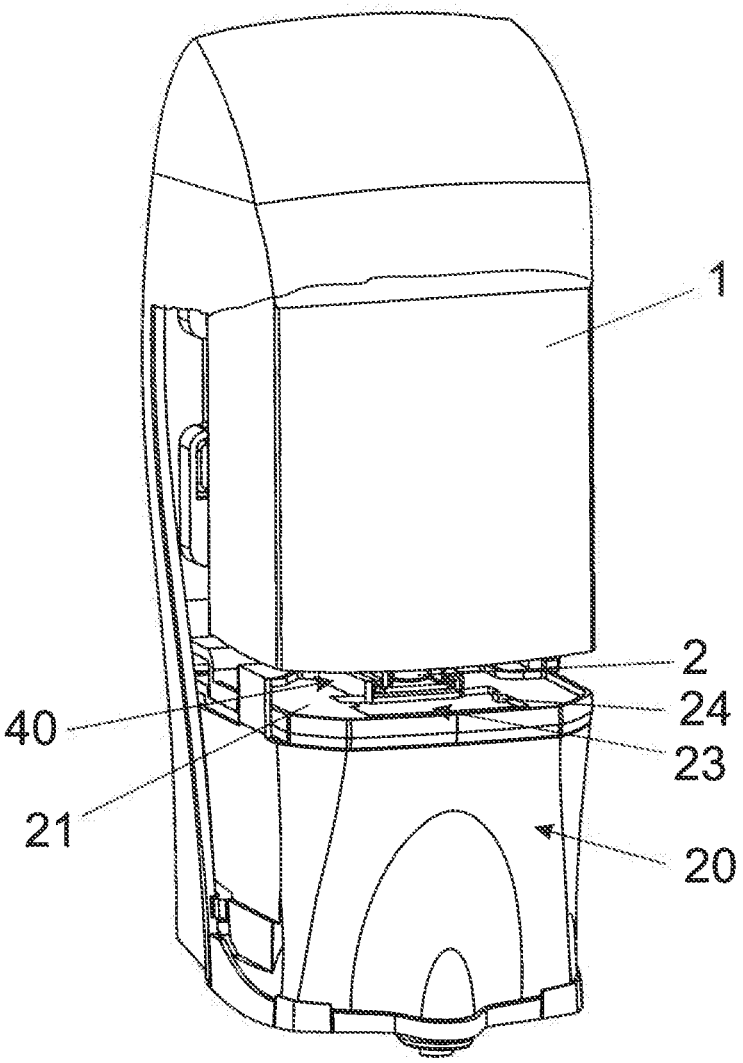
Figure 26:
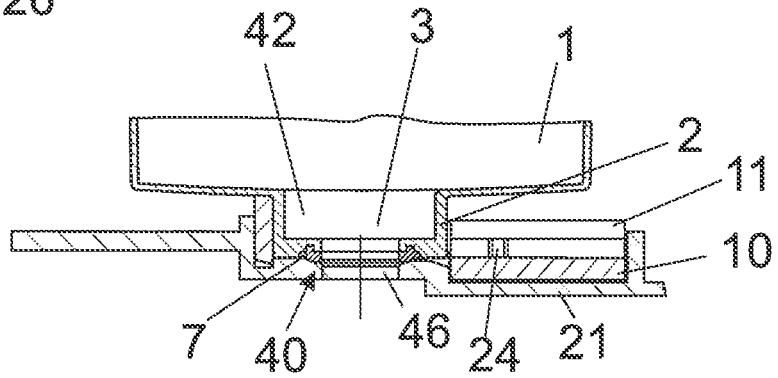
FIG. 26 is a sectional view as shown in FIG. 8 or FIG. 14 through the container mounting with an opened container as shown in FIG. 25.

The container 1 is intended in particular to receive liquid products like disinfectant, shampoo, soap or the like and, as shown in FIG. 19 or 25, is fitted upside down into a dispenser 20 so that the wall provided with the reinforcing plate 13 and the connection 2 forms the support side or the container bottom.

Figure 2:
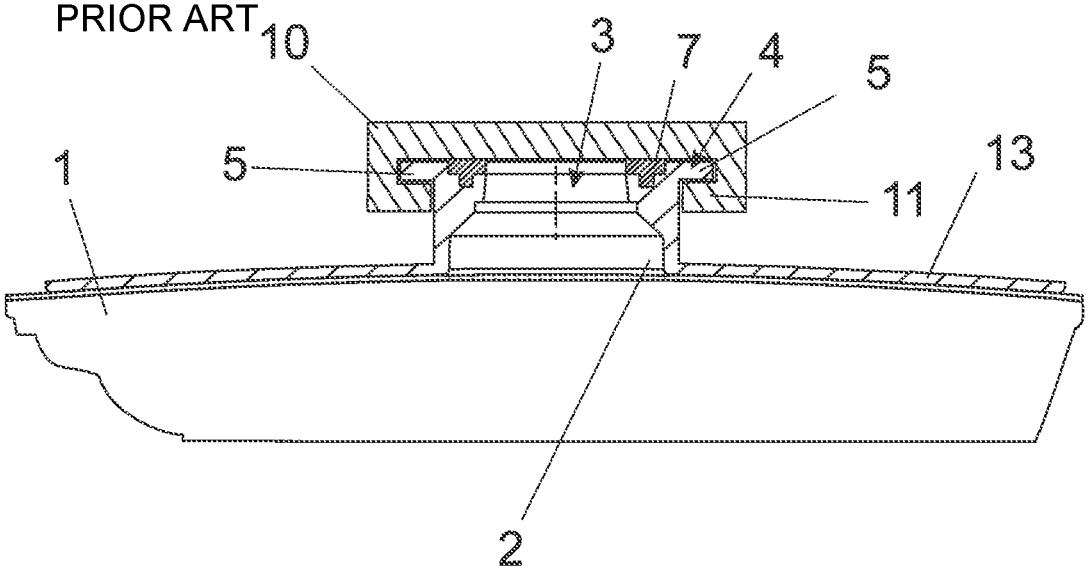
Fig. 2 PRIOR ART
FIG. 2 is a sectional view through an uppermost region of the container of FIG. 1.
Figure 3:
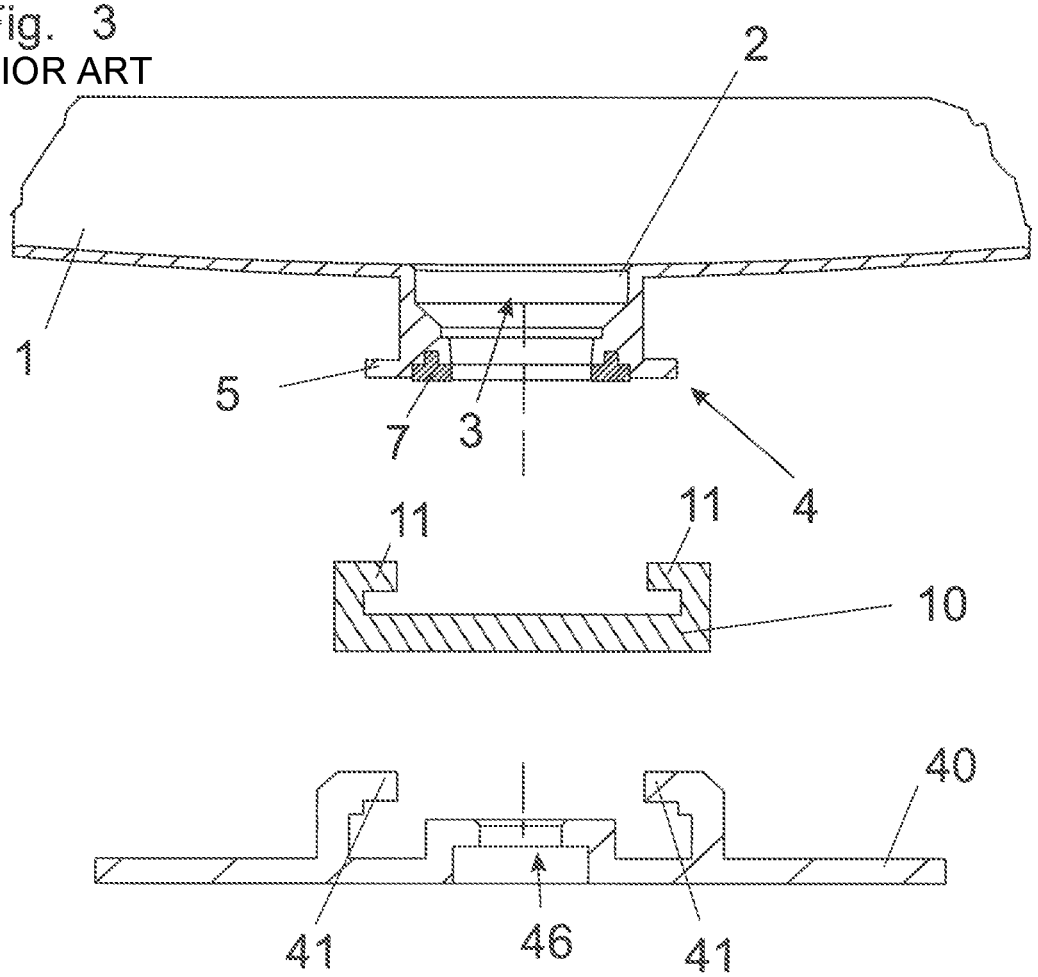
Fig. 3 PRIOR ART
FIGS. 3 and 4 are sectional views of the uppermost region of the upside down container in section as shown in FIG. 2 in opposite relationship to or in connection with a container mounting of a dispenser.

As shown in detail in FIG. 2 the connection 2 carries a guide element 4 in the form of limbs 5 projecting at both sides as a prolongation of its end face, and a sealing ring 7 projecting slightly from the end face. The closure 10 is in the form of an approximately clip-shaped or C-shaped body which is pushed on from the side, in which case it engages behind the limbs 5 with guide elements 11.

Figure 4:
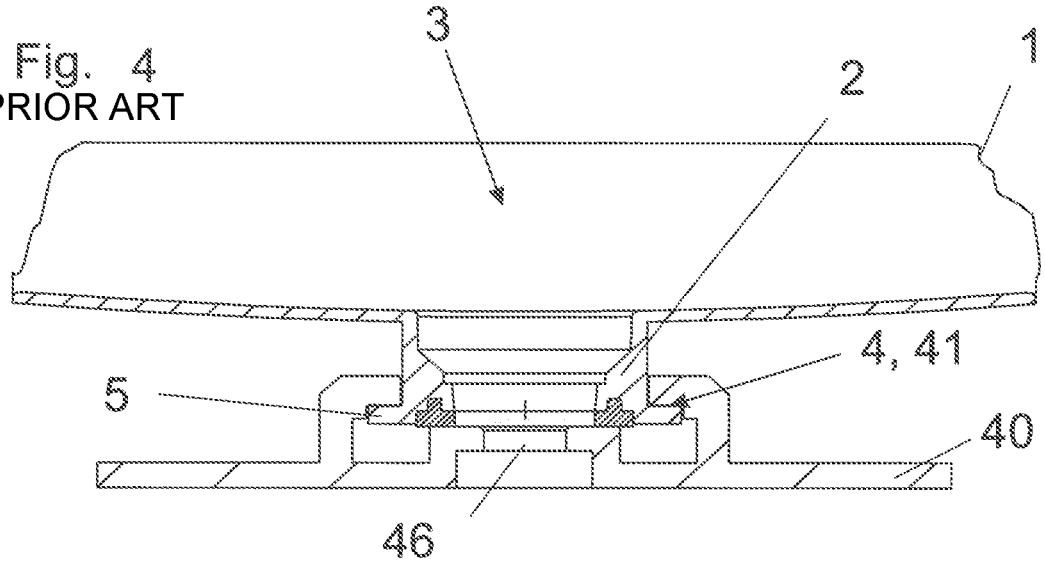
Fig. 4 PRIOR ART
Figure 6:
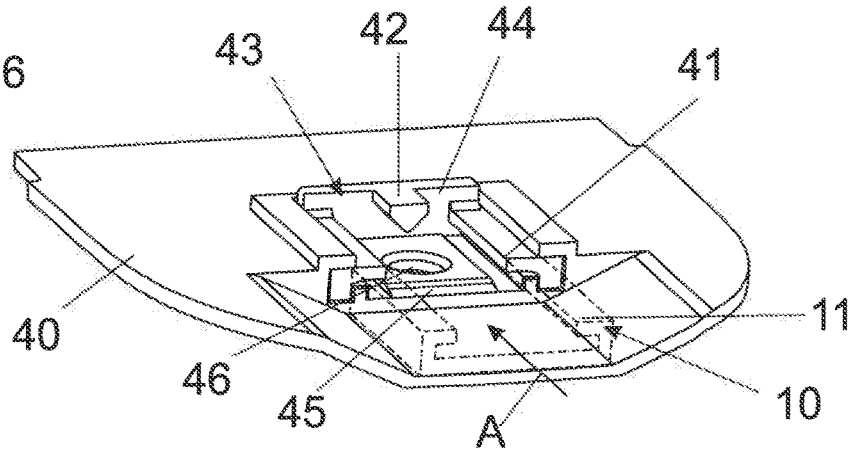
FIG. 6 is a perspective view of the container mounting of a dispenser, matching the container of FIG. 5.
Figure 7:
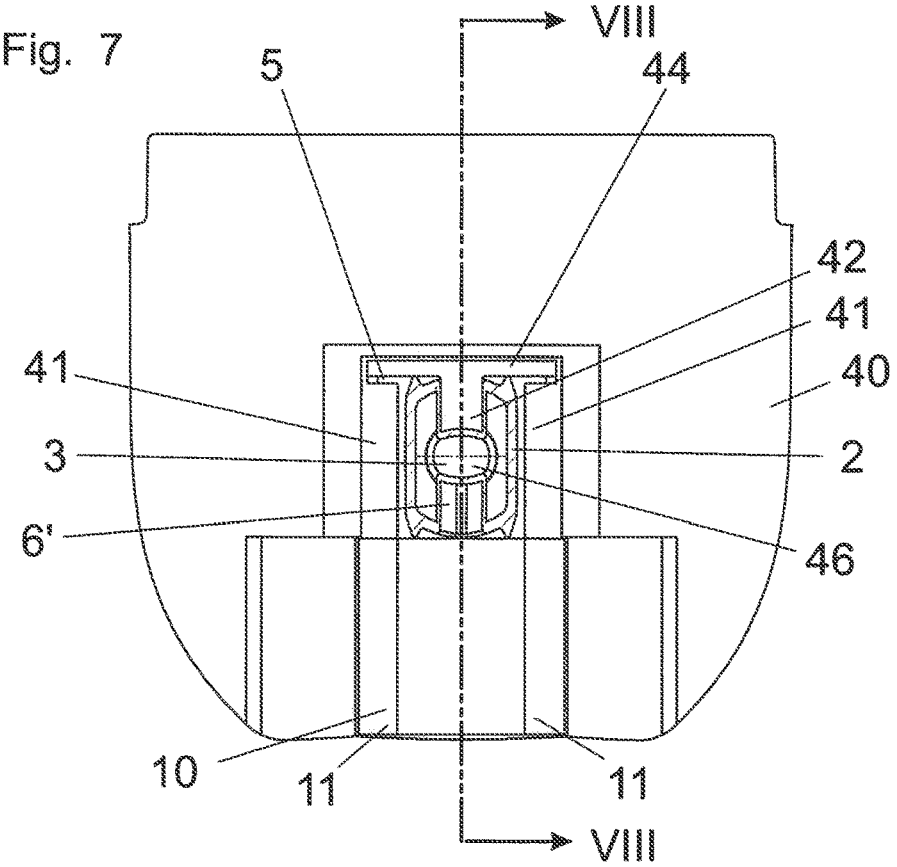
FIG. 7 is a horizontal sectional view through the container mounting of FIG. 6 with an inserted container.
Figure 8:
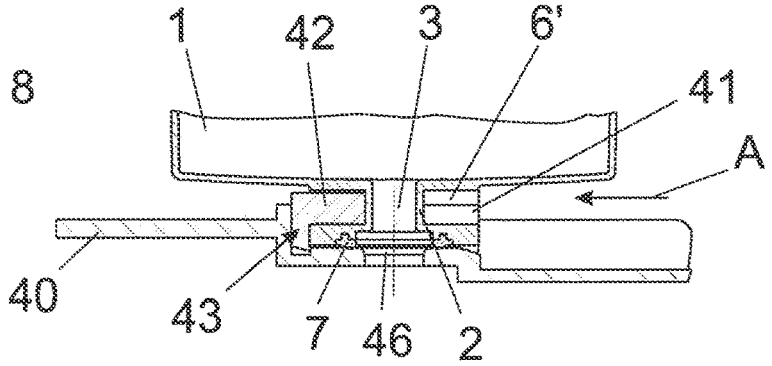
FIG. 8 is a sectional view taken along the line VIII-VIII shown in FIG. 7.
Figure 12:
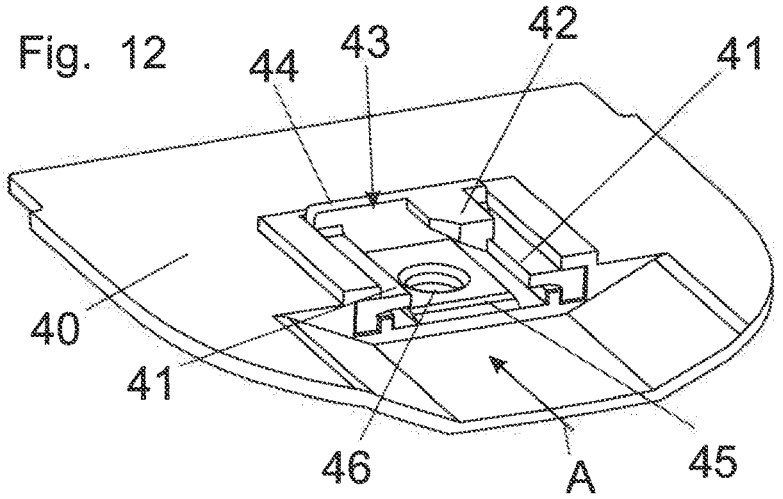
FIG. 12 is perspective view of the container mounting of a dispenser, matching the container of FIG. 11.
Figure 13:
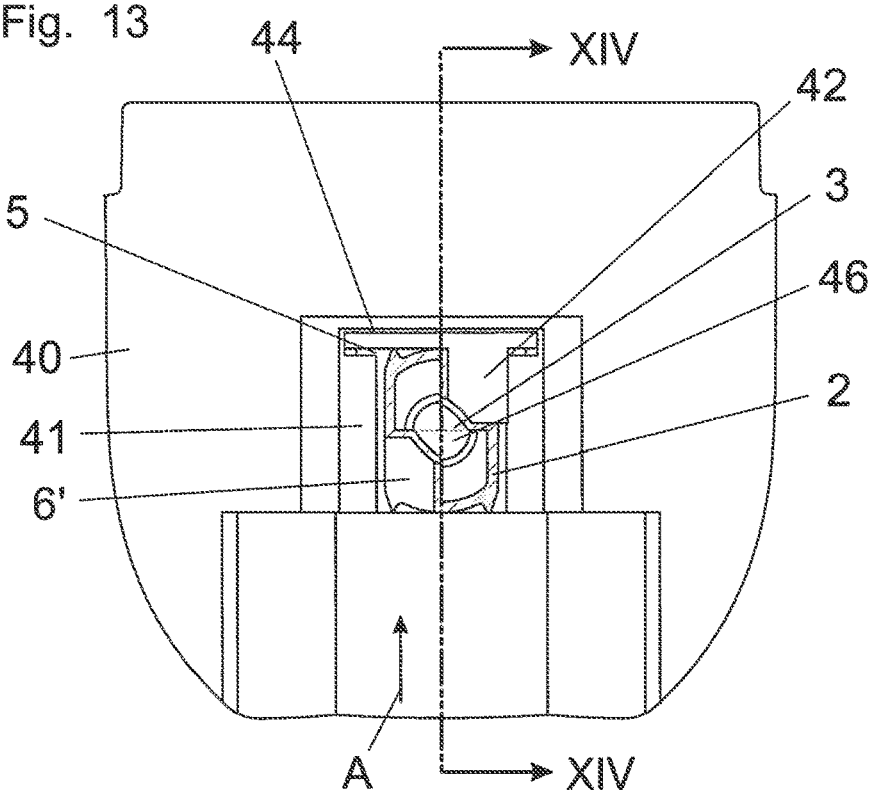
FIG. 13 is a horizontal sectional view through the container mounting of FIG. 12 with an inserted container.
Figure 14:
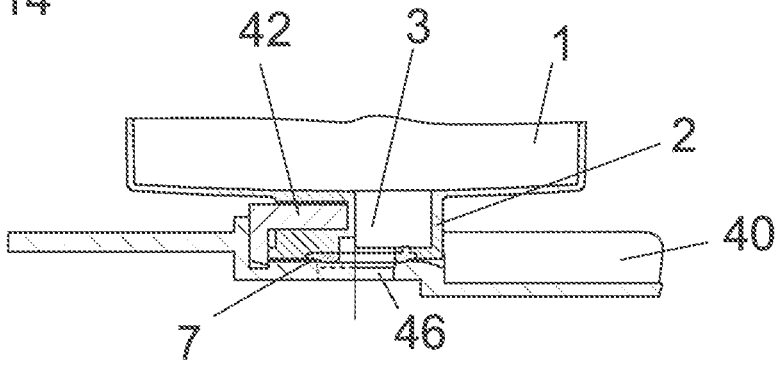

The configuration of a sliding guide on the connection 2, that embraces the guide elements 4, 11, simplifies insertion of the container 1 into the dispenser 20, of which further FIGS. 3, 4, 6 through 10 and 12 through 16 respectively only show the single element that is essential in that respect, namely the container mounting 40 on the cover plate 21 of the lower portion. The cover plate has an opening 46 which, when the container 1 is inserted and sealed by the sealing ring 7, aligns with the connection 2 and the opening 3 of the container 1 (FIGS. 4, 8, 14). As can be seen from the view in FIG. 3 the container mounting 40 on the cover plate 20 is of the same structure in regard to the guide elements as the closure 10 and can therefore also engage with its guide elements 41 behind the limbs 5 of the connection 2 when the container 1 is inserted into the container mounting 40. That is indicated in FIG. 6 showing the contour of the closure 10 in broken line. The container 1 is therefore applied with the closure 10 to the container mounting 40 in front of the guide device elements 41 and is then inserted by way of the bevel 45 in the direction of the arrow A, in which case the closure 10 becomes free and remains disposed at the application point, as shown in FIG. 7.

Figure 5:
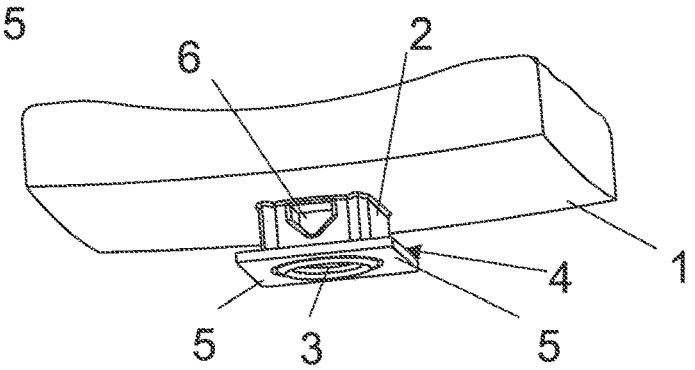
FIG. 5 is a perspective view of the uppermost region of a first embodiment according to the invention of a container in the position of use, without closure.
Figure 9:
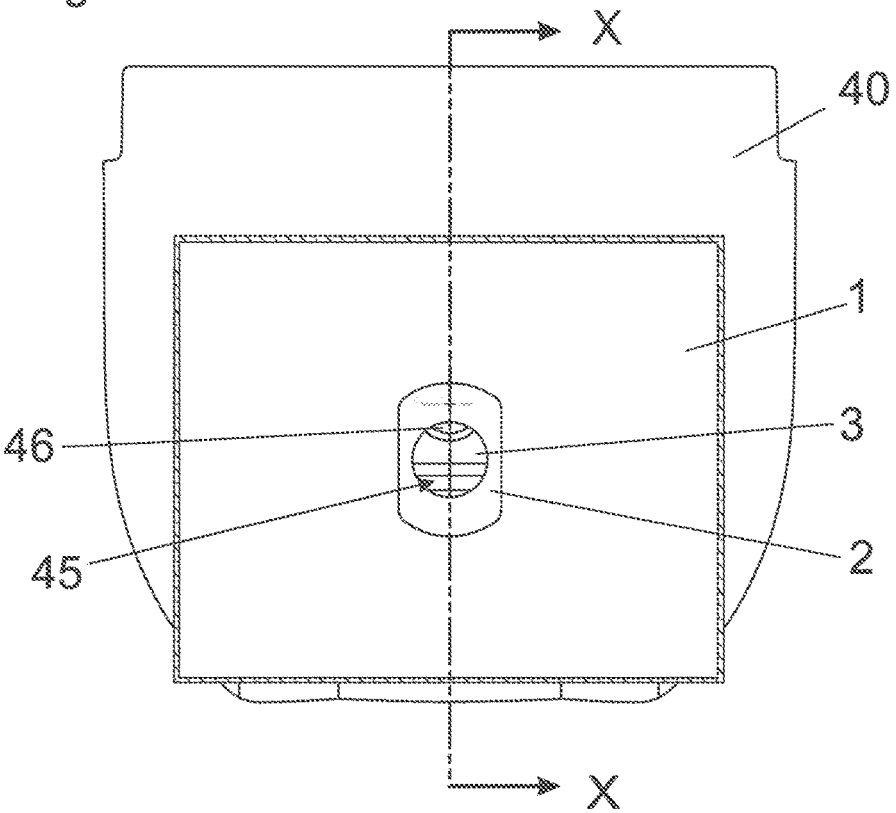
FIG. 9 is a horizontal sectional view corresponding to FIG. 7 with the container according to the prior art without a socket.
Figure 17:
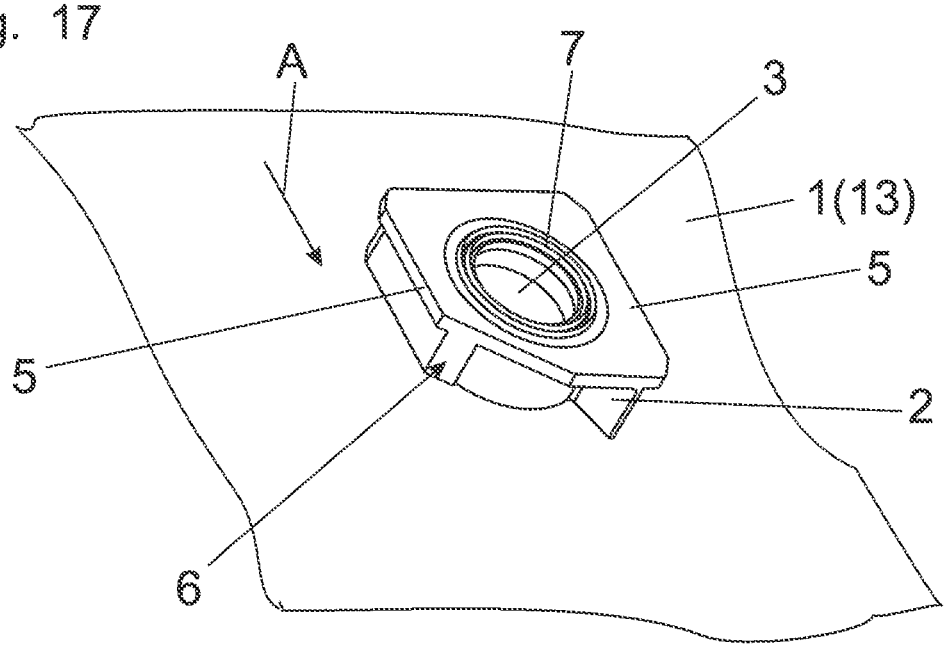
FIGS. 17 and 18 are perspective views of the uppermost regions of a third and a fourth embodiment according to the invention of a container, in each case without closure.

In order now to ensure that only suitable containers or containers with suitable contents can be fitted into the dispenser, there is provided a coding, that is to say the container and the container mounting must be provided with mutually matching elements. In particular therefore at least one projection 42 is provided at the container mounting 40 and at least one corresponding socket 6, 6' (FIGS. 5, 11 and 17) is provided at or in the connection 2 of each corresponding container 1, the projection and the socket respectively extending in the slide direction (arrow A) of the container 1. If the correct container is inserted then, as can be clearly seen from FIGS. 4, 8 and 14, the openings 3 and 46 are aligned. The depth of insertion is limited by the depth of the socket 6 and the length of the projection 42 and by a transverse limb 44 on the container mounting 40. FIG. 5 shows the upper region of a container 1 with a connection 2 in which there is provided a central socket 6 into which the central projection 42 shown in FIG. 6 engages. The cross-sections and lengths of the socket 6 and the projection 42 are the same. The inserted position in which the openings 5 and 46 are aligned can be clearly seen in the section in FIG. 8. The provision of a single central socket 6 is advantageous if only one installation position of the container 1 is wanted. If the aim is that the container 1 can also be inserted turned through 180° then a second central socket 6' is also provided in the connection 2, which is turned through 180° relative to the first, that is to say it is in diametrically opposite relationship, as shown in FIGS. 7 and 9. In cross-section therefore the connection 2 is of an H-shape. Like each socket 6, 6' in this embodiment the projection 42 has a cross-sectional area which is composed of a rectangle with adjoined triangle. If in spite of two mutually oppositely disposed sockets 6, 6' only one installation position is to be allowed for the container 1 in the dispenser, the closure 10 which is suited thereto can have a projection which fits into the second socket 6' so that the closure 10 can be opened only towards that side.

Figure 11:
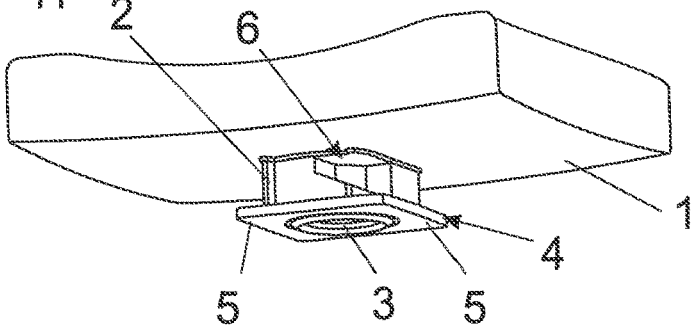
FIG. 11 is a perspective view of the uppermost region of a second embodiment according to the invention of the container in the position of use without closure.

FIG. 11 shows the upper region of a second embodiment of a container 1. In this variant the socket 6 is provided not centrally but laterally, and therefore a corner region of the connection 2 is missing. Here too a second socket 6' is preferably arranged turned through 180°, as can be seen from FIG. 13.

FIG. 12 shows the associated container mounting 40 in which the projection 42 is also provided off-center in the corner region. The socket 6 and the projection 42 in this embodiment are of a trapezoidal cross-sectional area. FIG. 13 shows a horizontal section through the connection 2 of the container 1 fitted into the container mounting, in which case by virtue of the socket 6 the connection 2 can be inserted as far as the abutment 44 so that the openings 3, 46 are aligned. That is again visible in the section in FIG. 14.

Figure 10:
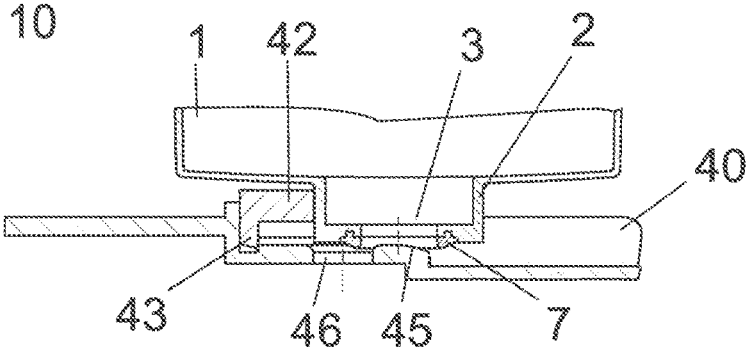
FIG. 10 is a sectional view corresponding to FIG. 8 with the container according to the prior art without the socket.
Figure 15:
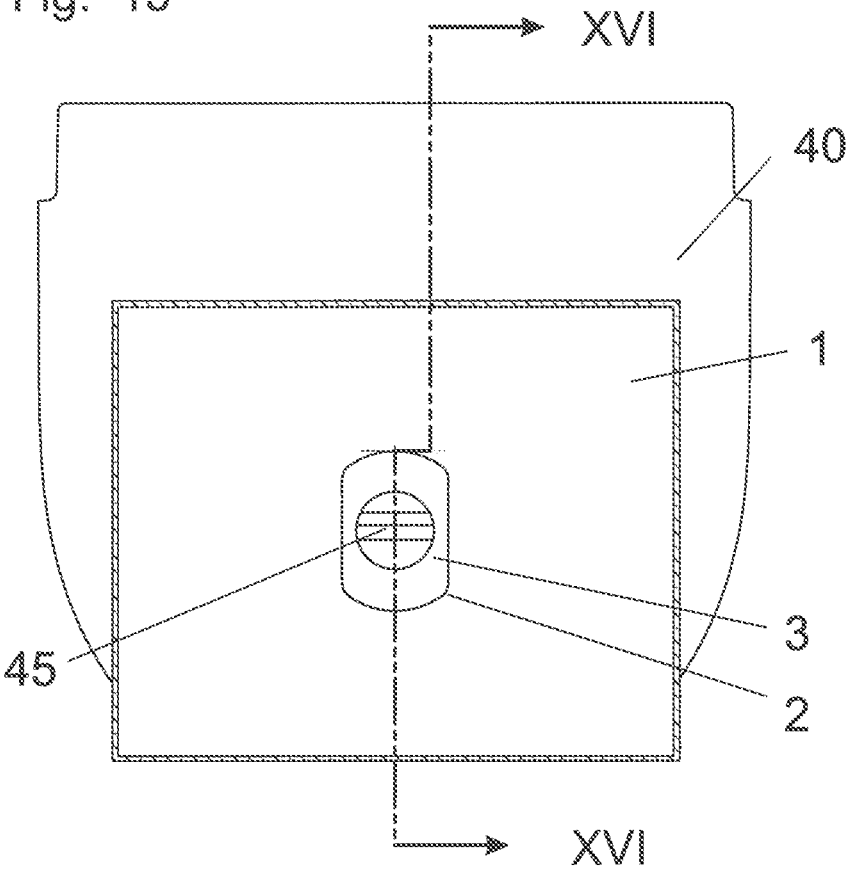
FIG. 15 is a horizontal sectional view corresponding to FIG. 13 with the container according to the prior art without the socket.
Figure 16:
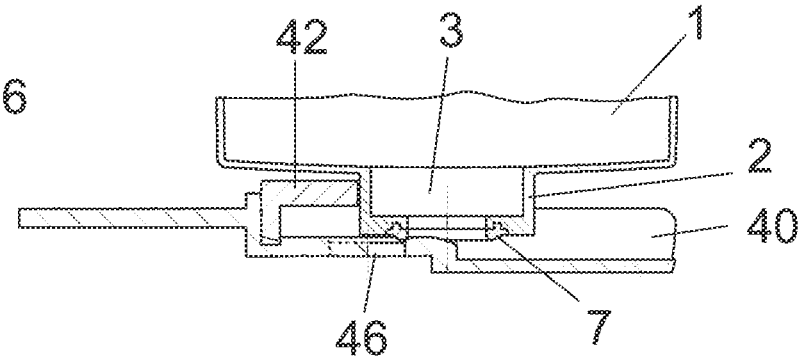
FIG. 16 is a sectional view corresponding to FIG. 14 with a container according to the prior art without the socket.

The insertion of an incorrect conventional container corresponding to FIGS. 9 and 15 without socket is practically out of the question since, as FIGS. 10 and 16 show, it can admittedly be inserted over a short distance, but the openings 3 and 46 are so displaced that no through-flow is achieved.

In the two embodiments shown in FIGS. 5 and 11 the sockets 6, 6' are provided on the connection 2 below the limbs 5 of the sliding guide, which thus extend over the entire depth or length. In the FIG. 17 embodiment the socket 6 extends over the entire height of the connection 2 so that one of the two limbs 5 is shortened. As more than half of the limb remains neither the sealed seat of the closure 10 on the connection 2 nor the seat of the connection 2 in the container mounting 40 is adversely affected.

Figure 18:
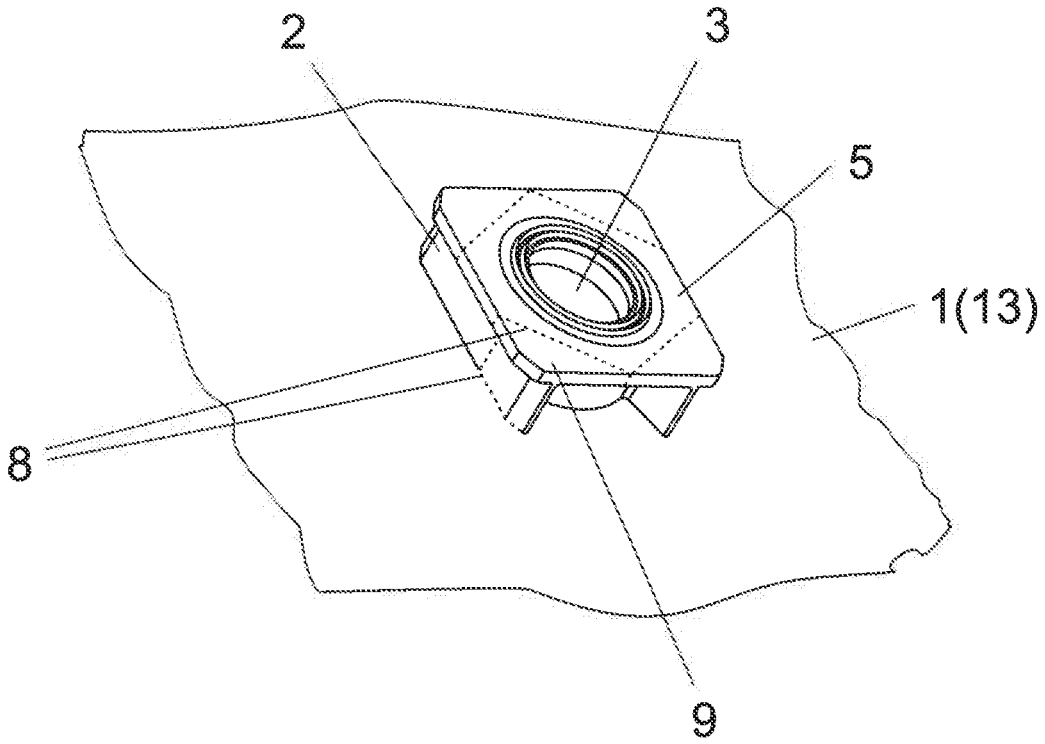

As FIG. 18 shows it is also conceivable for the socket 6 to be produced by breaking off at least one tab 9 which is held to the connection 2 by way of intended breaking lines 8.

In order to be able only later to establish the different coding options upon manufacture of the dispenser the projection 42, the guide elements 41 and the transverse limb 44 are advantageously provided on an insert portion 43 which can be arranged in matching relationship with the containers to be used with that dispenser, in the cover plate 21 of the lower portion of the container 1.

The above-described embodiments afford protection in particular against the insertion of conventional containers of different manufacturers as the projection in the container mounting means that recesses and sockets are required on the container, which as far as possible cannot be subsequently provided.

Reversal of the elements, namely a socket or a recess in the container mounting and a corresponding projection on the connection also represents a coding option in relation to a sliding closure. Such a configuration is desirable in particular when it is only a confusion of products from the same manufacturer, which in particular are not to be mixed up, that is to be excluded, as a conventional container without projection also fits into the container mounting. Such an embodiment is not shown in the figures. Rather, FIGS. 20 through 22 show a hybrid form in which projections and sockets are provided both on the container 1 and also on the container mounting 40.

The container 1 (indicated in FIG. 22) again has a reinforcing plate 13 which with the oppositely disposed limbs 14 embraces two container edges. Each limb 14 has between one and six holes which form sockets 6 belonging to the container 1 and into which between one and six projections 42 can pass upon insertion of the container 1 into the container mounting 40 or its insert portion 43.

In accordance with the rules of combinatorics it is possible to derive therefrom a relatively large number of possible options, each of which is then associated with a given product. FIG. 20 shows for example two such projections 42.

Figure 20:
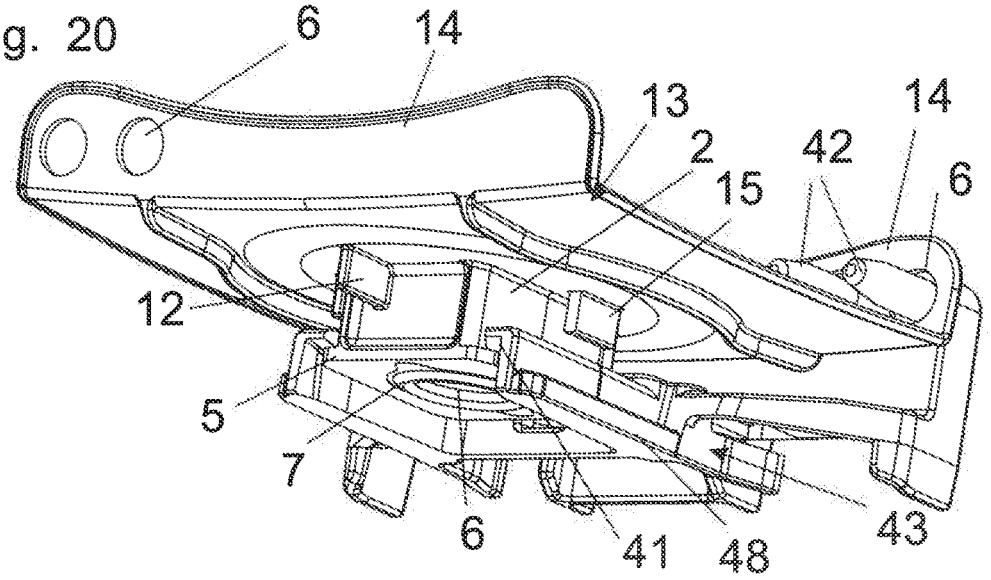
FIG. 20 is a perspective view of the uppermost region of a fifth and a sixth embodiment according to the invention of a container, inserted into an insert portion of the dispenser.
Figure 21:
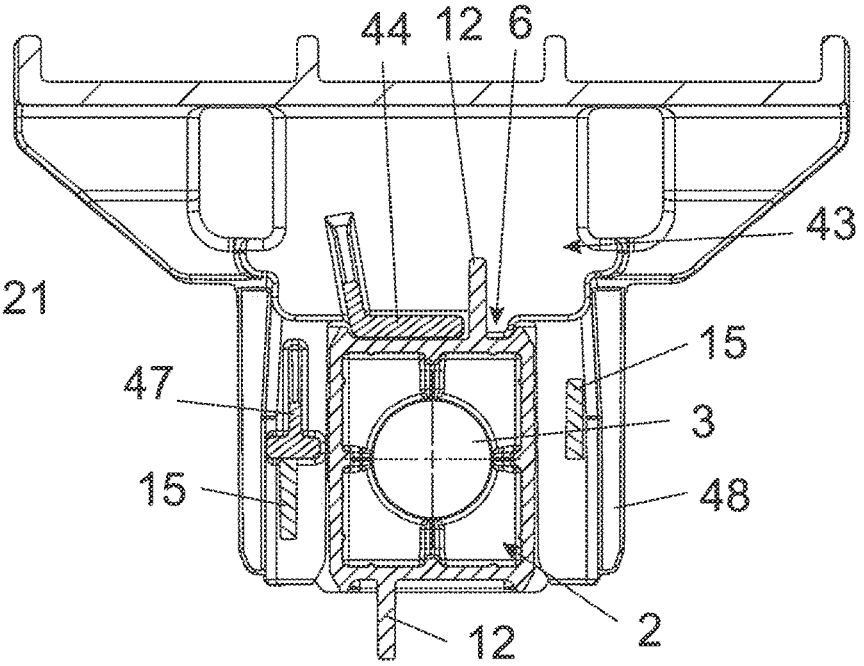
FIG. 21 is a horizontal sectional view taken along the line XXI-XXI shown in FIG. 22.
Figure 22:
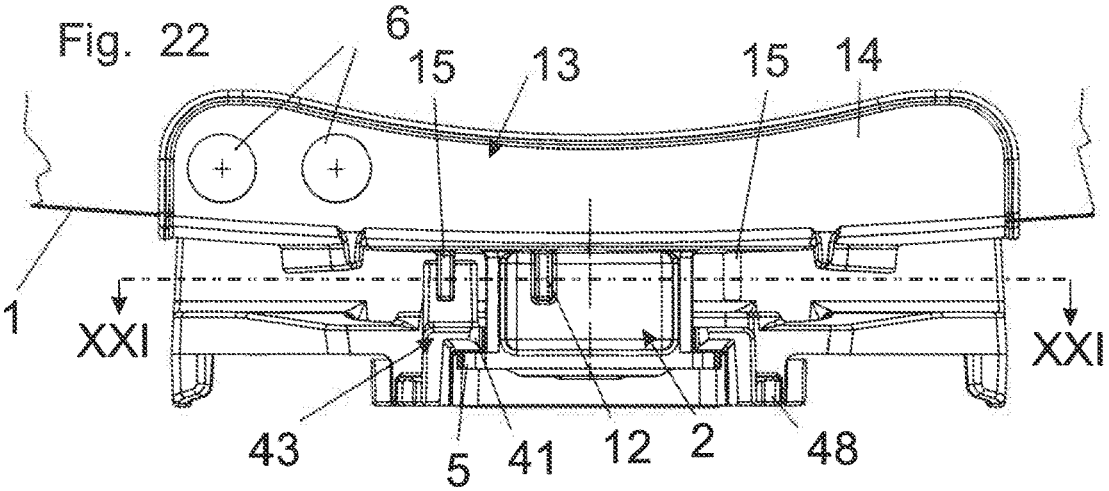
FIG. 22 is a front view of the elements shown in FIG. 20.

FIGS. 20 through 22 further also show projections 12 in the form of limbs which project from connections 2 in the slide direction (arrow A) and penetrate into a corresponding orientation or socket 6 or a corresponding recess on the container mounting 40 when the container 1 is inserted. In addition arranged on the reinforcing plate 13 are limbs 15 which extend in the slide direction approximately over the second half of the slide travel distance until they come to bear against the projection, which is visible in FIGS. 21 and 22, of the inset portion 43, in the form of an abutment 47. In that end position the connection 2 bears against the transverse limb 44 while the projection 12 has passed into the socket 6 and the opening 3 aligns with the opening 46 (not shown in these figures) in the container mounting 40. The abutment 47 is provided only at the left-hand side in the drawing and the second limb 15 provided at the right-hand side of the connection 2 does not impede insertion as an abutment 47 is missing at that side and a recess is thus also provided there. A container mounting 40 with an insert portion 43 as shown in FIGS. 20 through 22 prevents the insertion of conventional containers only by the projections 42 and the socket 6 in the region of the upstanding limbs 14 as no projections are provided, which require sockets on or in the connection 2. Abutments 47 on the insert portion 43 or on the container mounting 40 itself as well as limbs 12 or 15 on the connection and the reinforcing plate 13 serve primarily to associate given products with given dispensers.

Figure 23:
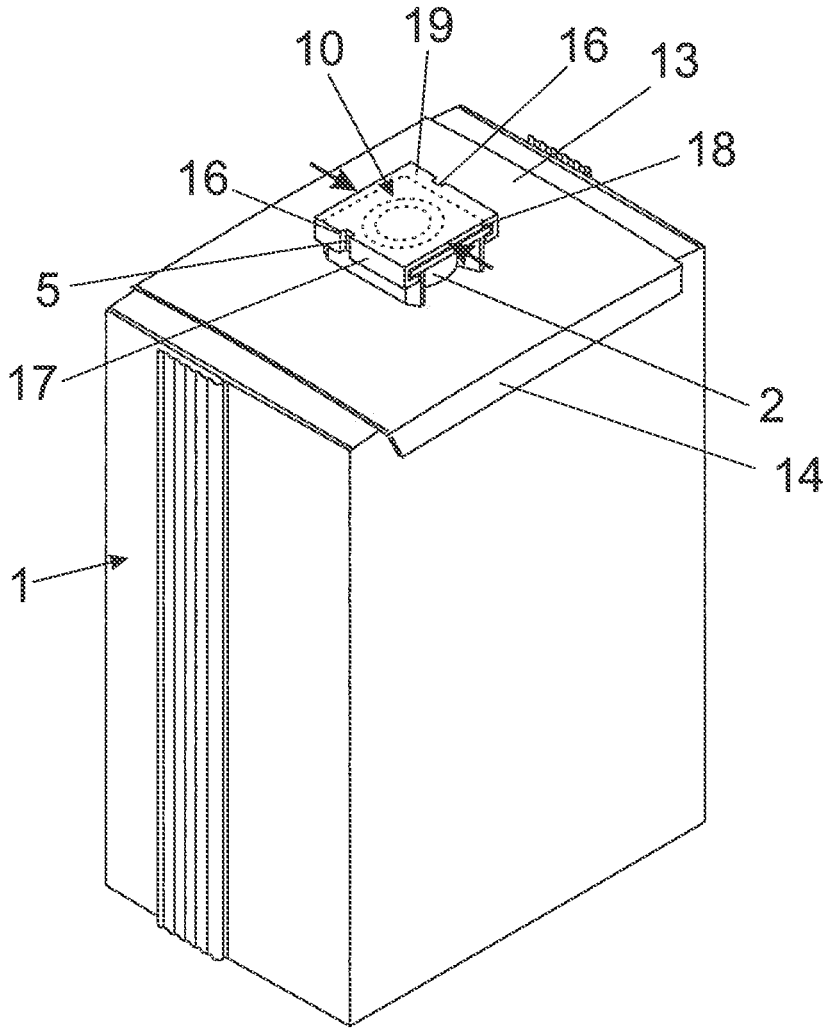
FIG. 23 is a perspective view of a seventh embodiment of a container with closure.
Figure 24:
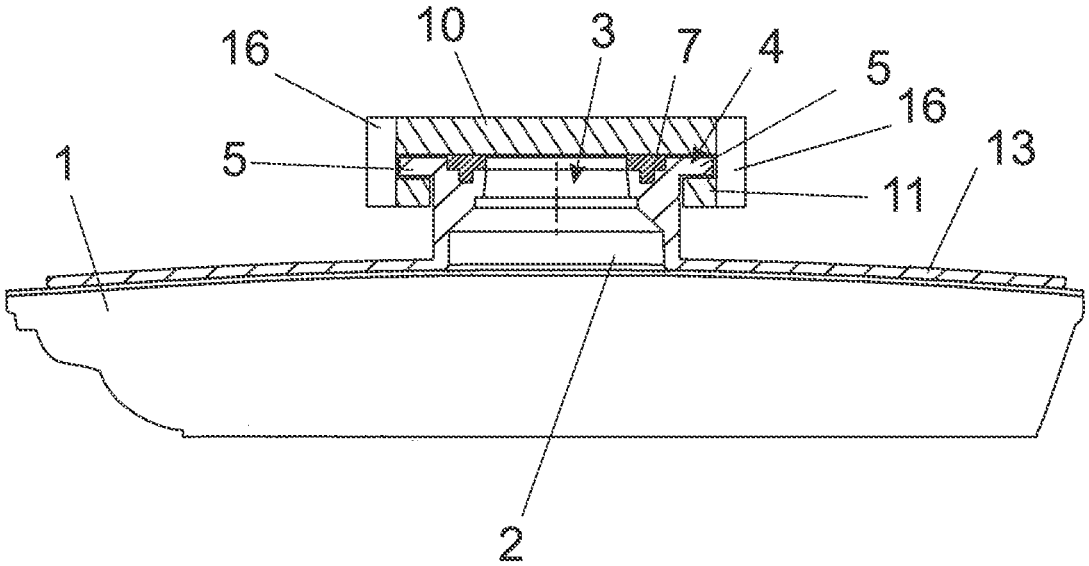
FIG. 24 is a sectional view through the uppermost region of the container of FIG. 25.

FIG. 23 shows a perspective view of a second embodiment of a container 1, on to the connection 2 of which there is pushed a closure 10 provided with a coding. The closure 10 shown in a number of configurations in FIGS. 23 through 34, as in the embodiments shown in FIGS. 1 through 22, includes an approximately C-shaped body with limbs 11 which engage behind limbs 5 on the connection 2 and has a top side 19 parallel to the plane of the container opening 3, two side surfaces 17 disposed in the slide direction (arrow A) of the container 1 and two side surfaces 18 perpendicular thereto.

Figure 28:
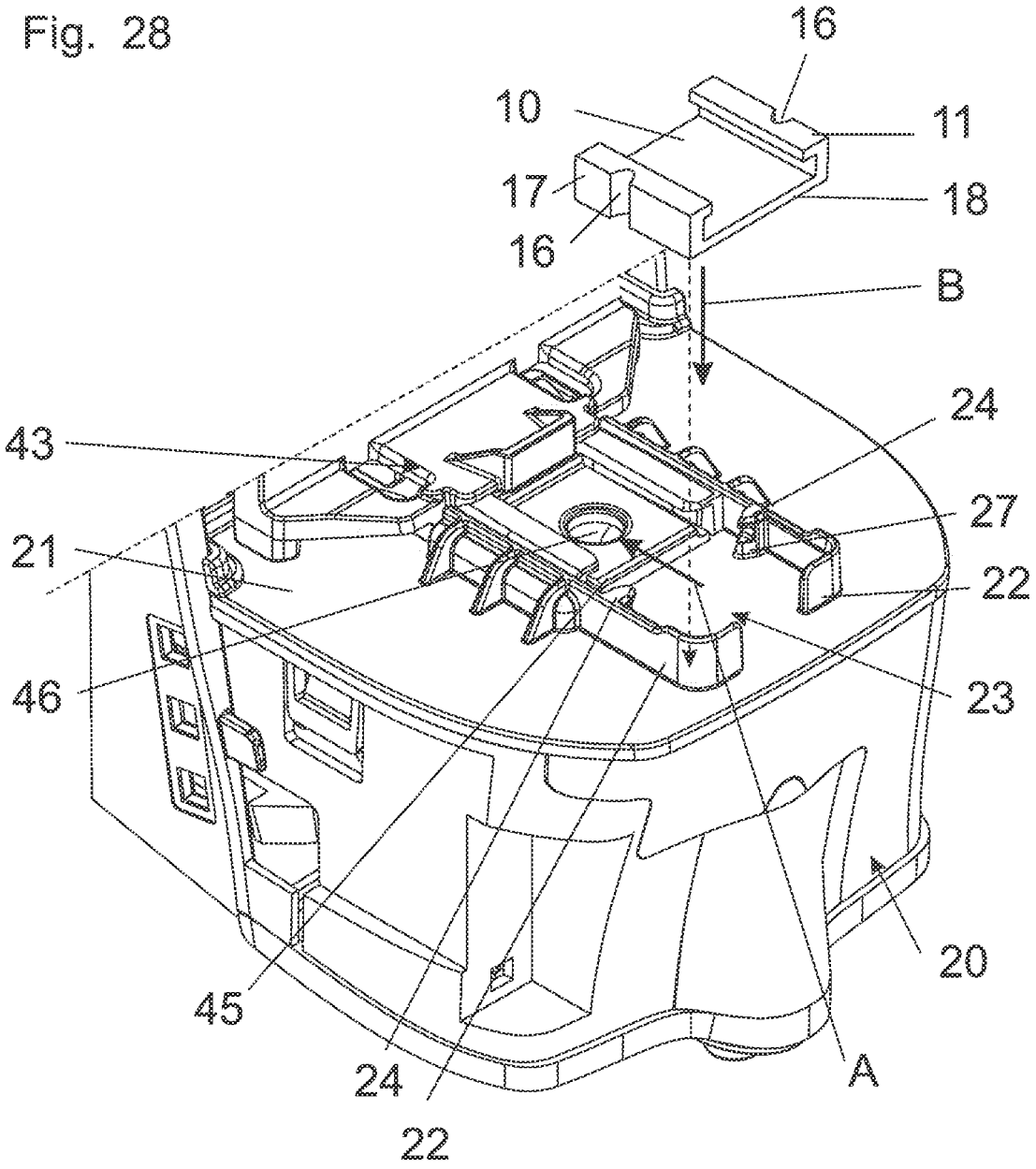
FIG. 28 is a perspective view of a second embodiment of a lower portion of the dispenser of FIG. 25.
Figure 29:
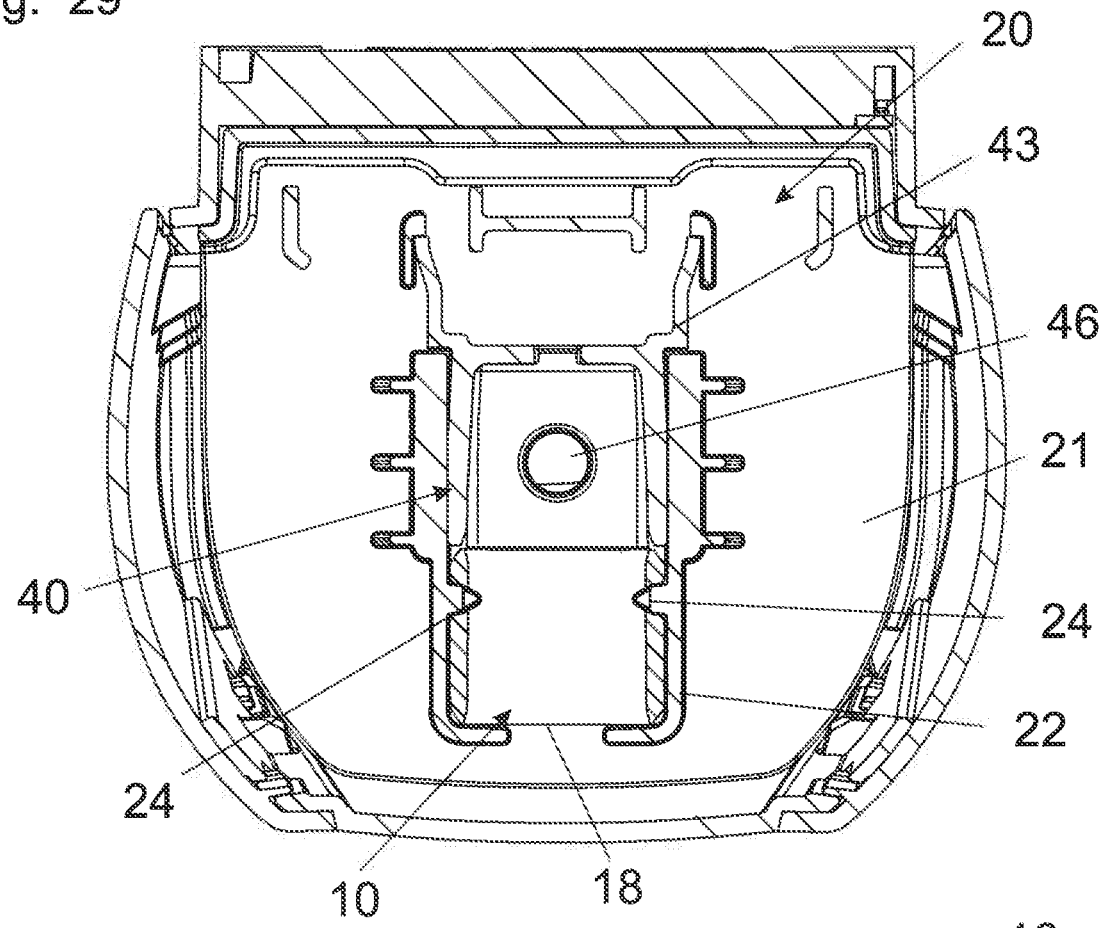
FIG. 29 is a plan view of the embodiment of FIG. 28 with a closure disposed in the deposit device without the container.
Figure 30:
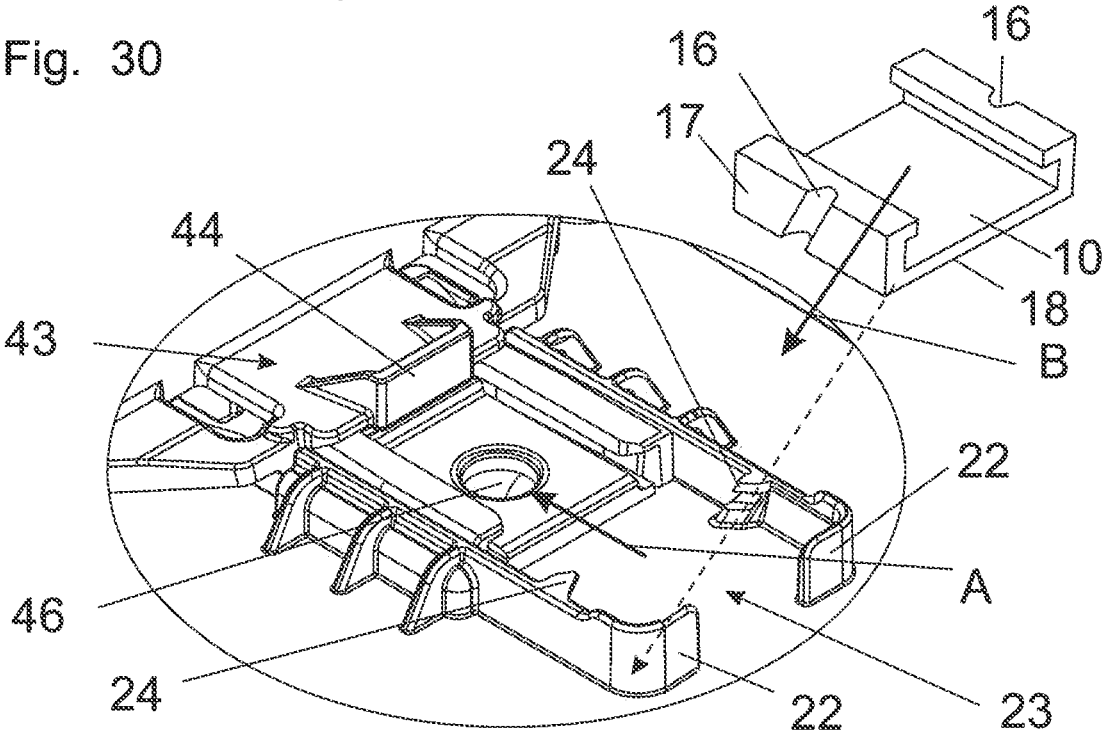
FIG. 30 is a perspective view of part of a third embodiment of a lower portion of the dispenser as shown in FIG. 25.

FIGS. 23 through 30 show closures 10 which in at least one of the two side surfaces 17 have a recess 16 serving as coding, in the form of a groove. In FIGS. 23 through 29 the groove 16 extends perpendicularly to the plane of the container opening 3 while in FIG. 30 it extends inclinedly forwardly. As can be seen from FIG. 24 the depth of the groove preferably corresponds to the wall thickness so that the limb 5 of the connection 2 is exposed or is not cut out. As counterpart elements in relation to the recess 16 it is possible to see corresponding projections 24 in the form of noses or limbs on the dispenser immediately in front of the container mounting 40. As can be seen from FIG. 25 the region of the cover 21 of the lower portion of the dispenser 20 is provided with a depression into which two projections 24 project. A container 1 as shown in FIG. 23 can now be introduced into the position in front of the container mounting 40 either horizontally from the side (FIG. 27), vertically from above (FIGS. 28 and 29) or inclinedly from above (FIG. 30). That signifies an at least approximately or precisely L-shaped travel path shown by the two arrows B and A.

Figure 27:
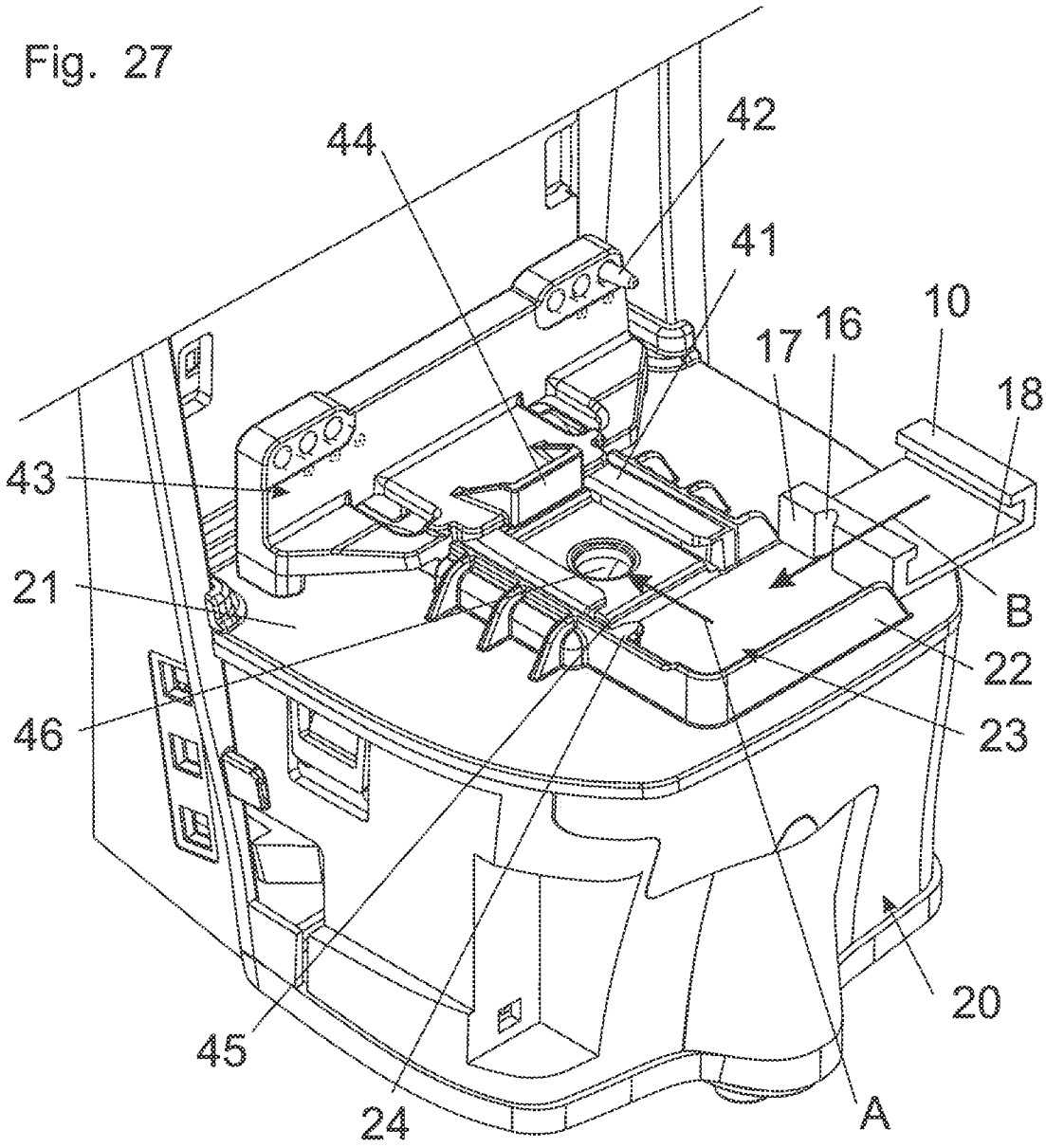
FIG. 27 is a perspective view of a first embodiment of a lower portion of the dispenser of FIG. 25.

In FIG. 27 the L-shaped path is parallel to the plane of the container opening 3 and to the plane of the opening 46 of the container mounting 40 and the closure 10 shown in FIG. 27—the container is not shown for the sake of clarity—moves over the first path portion corresponding to the arrow B into the chamber forming the deposit device 23 in front of the container mounting 40, in which case the projection 24 passes into the recess 16 when the two coding elements are identical. The deposit device 23 is deeper than the container mounting 40 by the thickness of the top side of the closure 10 so that the container can be further displaced in the direction of the arrow A, wherein the closure 10 remains disposed in the deposit device 23 and the medium contained in the container 1 can flow away through the openings 3 and 46 into the lower portion of the dispenser 20.

The deposit device 23 is defined by limbs 22 so that it receives the closure 10 in positively locking relationship. As a result the container 1 is moved on to the closure 10 again upon removal in opposite relationship to the slide direction (arrow A) and is then removed in a condition of again being closed in opposite relationship to the arrow B from the dispenser. The container 1 can therefore also be exchanged while still partly filled without a partial quantity of its contents being lost.

Referring to FIG. 28 the closed containers are lowered vertically from above (arrow B) and the closure 10 is again in the deposit device 23, as shown in FIG. 29, and the container can then be inserted into the container mounting 40 (arrow A).

FIG. 30 shows the inclined arrangement of the coding elements 16 and 24 and thus also the inclined direction (arrow B) of insertion into the deposit device 23. The second part of the travel path is again indicated by the arrow A into the container mounting 40.

FIGS. 27, 28 and 30 each show a perspective view illustrating the lower portion of a dispenser 20 with the cover plate 21 on which the container mounting 40 and an insert portion 43 corresponding to FIGS. 20 through 22 is provided. The only difference is the transverse limb 44 which is continuous over the width so that the container to be used here is without projections. Likewise, the abutment 47 is missing, in comparison with the configuration shown in FIGS. 20 through 22.

Figure 31:
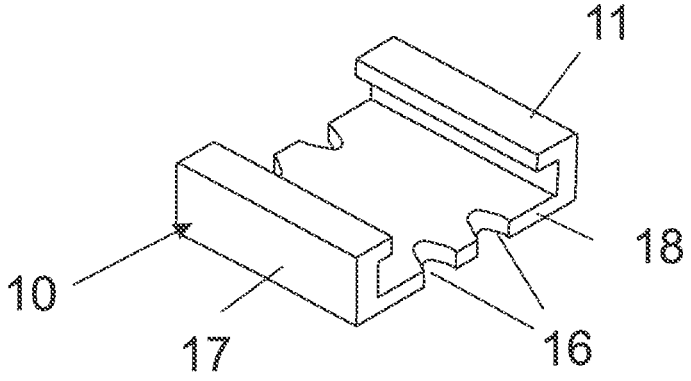
FIG. 31 is a perspective view of a third embodiment of a lower portion of the dispenser of FIG. 25 with the closure disposed in the deposit device, without the container.
Figure 32:
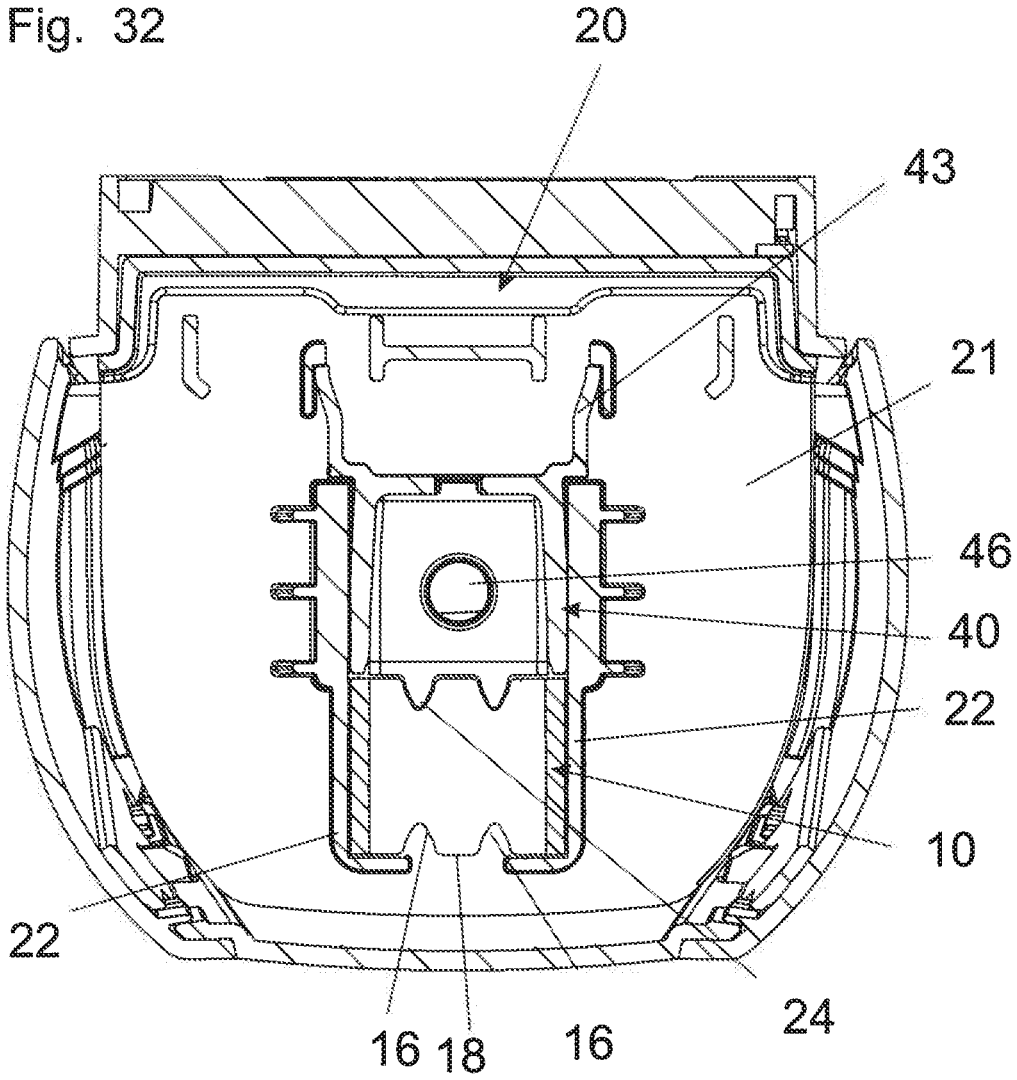
FIG. 32 is a plan view of a third embodiment of a lower portion of the dispenser of FIG. 25 with the closure disposed in the deposit device, without the container.

FIGS. 31 and 32 show a closure 10 on which recesses 16 are provided in the narrow side surfaces 18, wherein recesses are optionally also possible in the side surfaces as shown in FIG. 23.

The closure 10 shown in FIGS. 31 and 32 can only be introduced from above into the deposit device 23 so that insertion from the side, as shown in FIG. 27, is not possible. The other two options shown in FIGS. 28 and 30 can also be implemented with the closure 10 of FIG. 31. The closed container is inserted between the defining limbs 22 which project up from the cover plate 21, into the deposit device 23 adjoining the container mounting 40, the projections 24 passing into the recesses 16 (FIG. 32). The container is now further pushed into the container mounting 40, with the closure 10 remaining in the deposit device 23. If the container 1 is to be replaced when empty or when still partially filled it is moved back again into the deposit device 23, in which case the closure 10 which is locked in that direction by the defining limb 22 is again pushed on to the connection 2 and sealingly closes the container. Subsequently the closed container is removed.

In this embodiment also a number of coding options are afforded by a variation in the projections 24, in the region of the deposit device 23 for the closure 10. The projections 24 project from the edge of the container mounting 40 and engage into the recess 16 at the side surface 18 of the closure 10. The closure 10 again remains in the deposit device 23 when the container 1 is pushed into the container mounting 40.

Figure 33:
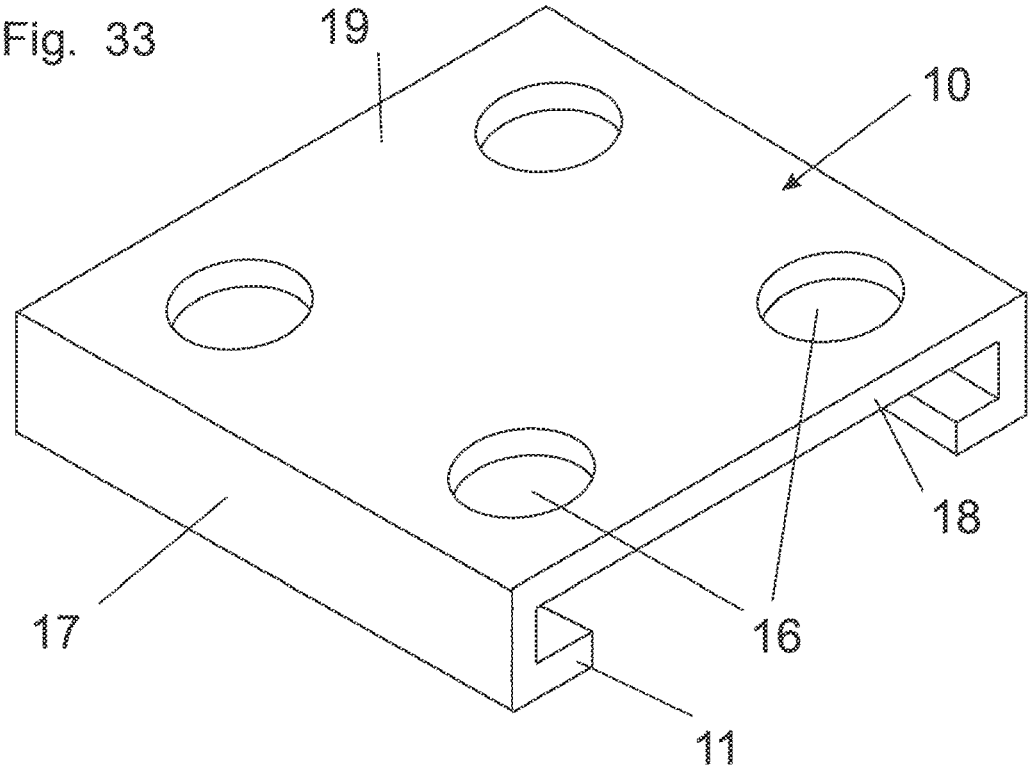
FIG. 33 is a perspective view of a fourth embodiment of a lower portion of the dispenser of FIG. 25 with the closure disposed in the deposit device, without the container.
Figure 34:
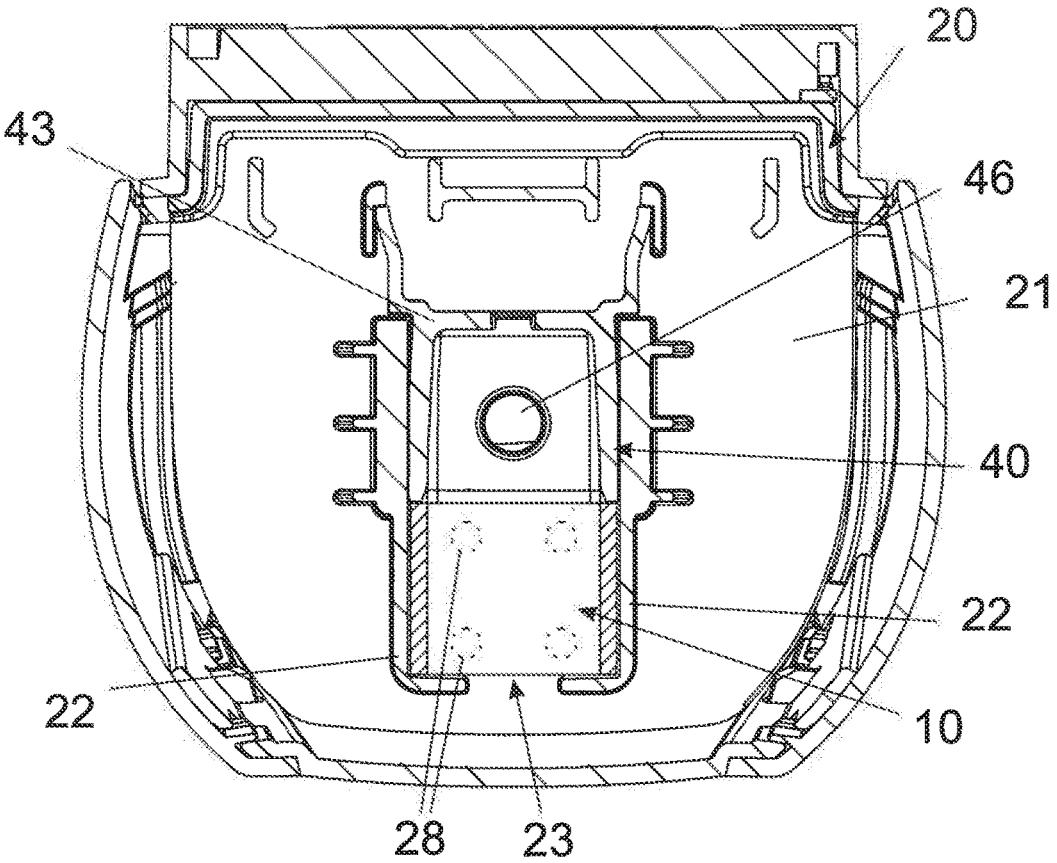
FIG. 34 is a plan view of the fourth embodiment of a lower portion of the dispenser of FIG. 25 with the closure disposed in the deposit device, without the container.
Figure 35:
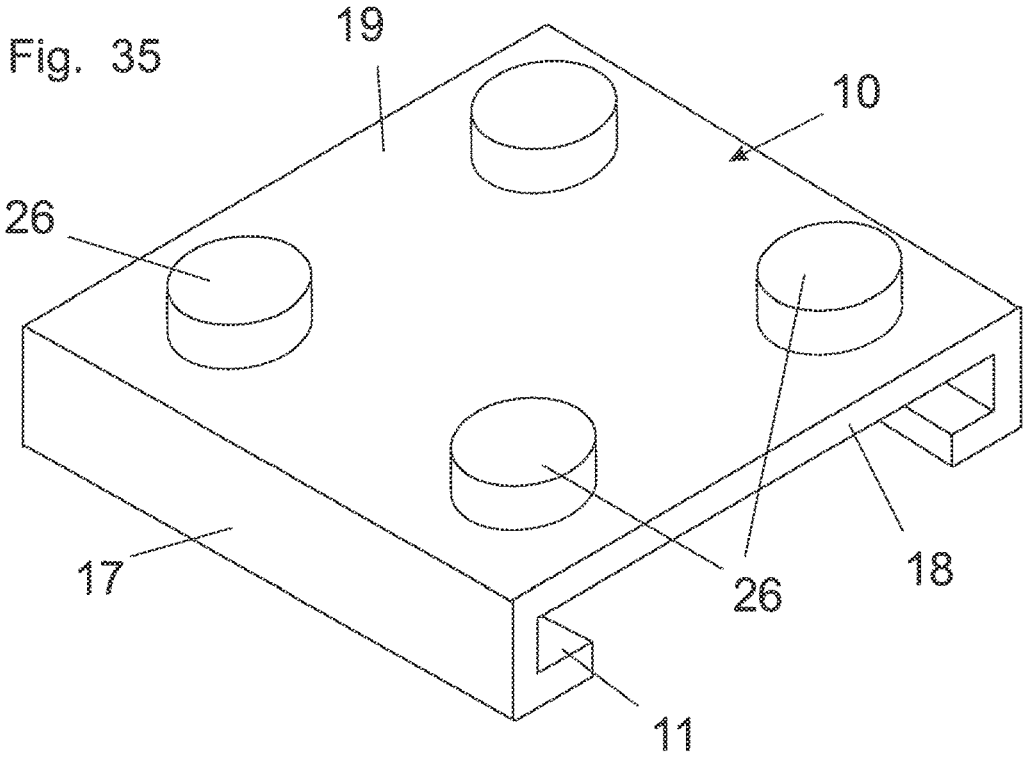
FIG. 35 is a perspective view of a fifth embodiment of a lower portion of the dispenser of FIG. 25 with the closure disposed in the deposit device, without the container.

FIGS. 33 through 36 show coding elements at the top side 19 of the closure 10, in which respect as shown in FIG. 33 the recesses 16 are in the form of cylindrical depressions, possibly also holes, while in FIG. 35 they are in the form of cylindrical projections 26. The corresponding counterpart portions are provided in the bottom surface of the deposit device 23, that is to say as shown in FIG. 34 the projections 28 shown in broken lines project there in the form of cylindrical knobs or the like and in FIG. 36 depressions 25 are in the form for example of cylindrical blind holes in the cover 21.

Projections 24, 27, 28 (limbs, noses, knobs and so forth) projecting into the deposit device 23 allow holes in the cover plate 21, which are covered over by the projections 24, 27, 28, to explain tamper protection. If those projections of the deposit device 23 are removed in order to be able to insert for example containers 1 as shown in FIG. 1 without a recess 16 in the closure 10 then those holes are exposed.

Preferably provided in the dispenser 20 beneath the cover 21 is a chamber (in particular an intermediate container, a pump chamber or the like), into which the liquid flows out of the container 1 fitted into the container mounting 40 (FIG. 19) and which loses sealing integrity due to the removal of the projection 24.

In FIGS. 29 and 32 the closure 10 is sectioned in each case parallel to the plane of the container opening 3 whereby engagement of the projections 24 into the recess 16 is more clearly apparent. The section plane extends directly beneath the limbs 11 of the closure 10.

Figure 36:
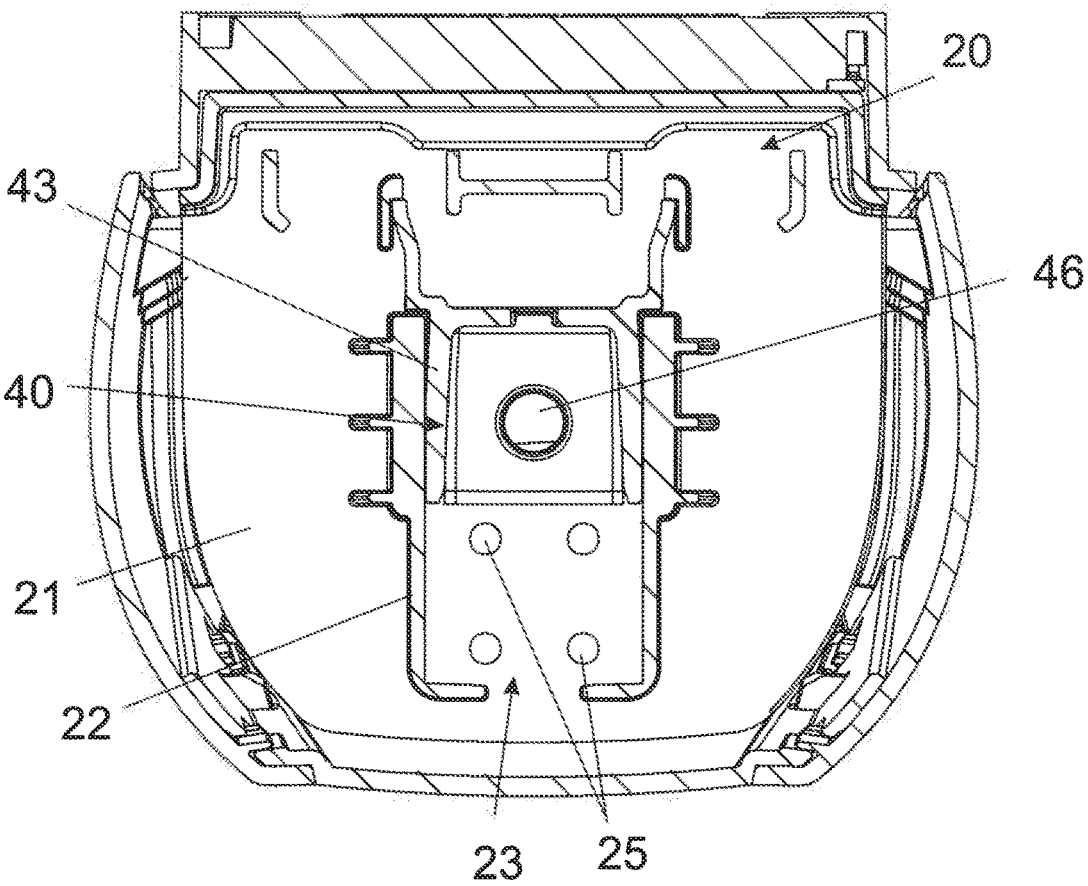
FIG. 36 is a plan view of the fifth embodiment of the lower portion of the dispenser of FIG. 25 with the closure disposed in the deposit device, without the container.

The section planes in FIGS. 34 and 36 are in the same position, the closure 10 not being shown in FIG. 36.

In FIGS. 28 and 30 the projections 24 projecting into the deposit device 23 are subdivided horizontally whereby a second projection 27 remains at the bottom of the deposit device 23, and that projection, as mentioned above, exposes a hole in the cover when it is removed.

The invention claimed is:

1. A dispensing system for a flowable product, comprising:

at least one dispenser having a container mounting and at least one container containing the flowable product, said container having a closure removable by displacement of said container and said container is held upside down in said container mounting after removal of said closure, said closure and said container mounting having matching guide elements supplementing each other or prolong each other upon insertion of said container being a closed container; and a deposit device disposed in front of said container mounting for said closure, said deposit device holding said closure back in a parking position during insertion of said container, said deposit device including a substantially L-shaped path for insertion of said closed container into said dispenser, said L-shaped path having a first path portion extending into said deposit device and a second path portion extending perpendicular from said first path portion in a direction of said container mounting.

2. The dispensing system according to claim 1, wherein when said container is moved out of said container mounting, said closure waiting in the parking position moves on to said container again.

3. The dispensing system according to claim 1, wherein:

said deposit device is delimited at at least three sides;

said closure has outside surfaces with at least one recess or projection formed therein; and said deposit device has delimiting surfaces with a matching projection or a matching recess for each said recess or said projection of said closure.

4. The dispensing system according to claim 1, wherein:

said deposit device has a projection; and said closure has outside surfaces with at least one recess formed in one of said outside surfaces and is held in a condition of bearing against said container mounting in said deposit device by said projection engaging into said recess of said closure.

5. The dispensing system according to claim 1, wherein said first path portion extends horizontally.

6. The dispensing system according to claim 1, wherein said first path portion extends vertically.

7. The dispensing system according to claim 1, wherein said second path portion leads in the slide direction from said deposit device into said container mounting for removal of said closure.

8. The dispensing system according to claim 1, wherein:

said dispenser has a cover plate and said container mounting is disposed on said cover plate in a lower portion of said dispenser, said cover plate having a depression formed therein; and said deposit device for said closure is disposed in said depression in said cover plate at an end of said first path portion.

9. The dispensing system according to claim 8, wherein:

said closure has a central part; and a height of said depression substantially corresponds to a thickness of said central part of said closure.

10. The dispensing system according to claim 8, wherein said at least one projection projects into said deposit device and covers over an opening in said cover plate.

11. The dispensing system according to claim 8, further comprising an exchangeable insert portion, wherein parts of at least one of said container mounting or said deposit device, that contribute to a coding, are disposed on said exchangeable insert portion which is held in said cover plate in a lower portion of said dispenser.

* * * * *